US009394085B2

(12) United States Patent
Nakano

(10) Patent No.: US 9,394,085 B2
(45) Date of Patent: Jul. 19, 2016

(54) PACKAGE BODY

(71) Applicant: KAO CORPORATION, Tokyo (JP)

(72) Inventor: Takashi Nakano, Utsunomiya (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 14/405,347

(22) PCT Filed: Apr. 17, 2013

(86) PCT No.: PCT/JP2013/061410

§ 371 (c)(1),
(2) Date: Dec. 3, 2014

(87) PCT Pub. No.: WO2013/183372

PCT Pub. Date: Dec. 12, 2013

(65) Prior Publication Data

US 2015/0151885 A1 Jun. 4, 2015

(30) Foreign Application Priority Data

Jun. 4, 2012 (JP) ..... 2012-126729

(51) Int. Cl.
*B65D 41/32* (2006.01)
*B65D 75/58* (2006.01)
*B65D 83/08* (2006.01)

(52) U.S. Cl.
CPC ..... *B65D 41/32* (2013.01); *B65D 75/5838* (2013.01); *B65D 83/0805* (2013.01)

(58) Field of Classification Search
CPC ..... B65D 2575/586; B65D 75/5838; B65D 75/5855; B65D 77/206; B65D 77/2096; B65D 2577/2091; B65D 83/0805; B65D 2577/2033; Y10S 206/812
USPC ..... 220/266
See application file for complete search history.

(56) References Cited

U.S. PATENT DOCUMENTS 4,739,879 A 4/1988 Nakamura
6,026,953 A * 2/2000 Nakamura ..... B65D 75/5838 206/233
6,454,161 B1 * 9/2002 Rendina ..... B65D 5/746 220/255.1

(Continued)

FOREIGN PATENT DOCUMENTS

EP 0 488 967 A1 6/1992
JP 1-167085 A 6/1989

(Continued)

OTHER PUBLICATIONS

English Translations of the International Preliminary Report on Patentability and Written Opinion of the International Searching Authority (Forms PCT/IB/338, PCT/IB/373 and PCT/ISA/237), dated Dec. 18, 2014, for International Application No. PCT/JP2013/061410.

(Continued)

*Primary Examiner* — Shawn M Braden
(74) *Attorney, Agent, or Firm* — Birch, Stewart, Kolasch & Birch, LLP

(57) ABSTRACT

A package (1) of the present invention has a container (3) containing a packaged material (2), a covering sheet (4) fixed to so as to cover a dispensing slot (31) of the container (3), and a reseal label (5) stuck so as to cover a dispensing slot (41) of the covering sheet (4). The reseal label (5) has a fixed portion (51) and a reseal portion (52) capable of being peeled and lifted. The container (3) has a projecting container cutting line (32) to form the dispensing slot (31). The covering sheet (4) has, outside the container cutting line (32), a projecting covering-sheet cutting line (42) to form the dispensing slot (41). When the reseal portion (52) of the reseal label (5) is lifted, a root portion (52*a*) of the reseal portion (52) has a three-layered portion composed of the reseal label (5), a separation piece (420) separated along the covering-sheet cutting line (42), and a separation piece (320) separated along the container cutting line (32).

13 Claims, 8 Drawing Sheets

(56) References Cited

U.S. PATENT DOCUMENTS

| | | | | |
|---|---|---|---|---|
| 7,703,602 | B2 * | 4/2010 | Saito | A47K 10/421 206/210 |
| 7,963,413 | B2 * | 6/2011 | Sierra-Gomez | B65D 75/44 229/256.1 |
| 8,181,783 | B2 * | 5/2012 | Kakura | B65D 75/5838 206/494 |
| 8,545,099 | B2 * | 10/2013 | Davis | B29C 59/007 220/266 |
| 2009/0232425 | A1 * | 9/2009 | Tai | B31B 19/90 383/211 |
| 2011/0163100 | A1 | 7/2011 | Ueda et al. | |
| 2012/0048857 | A1 | 3/2012 | Bando | |
| 2012/0177307 | A1 * | 7/2012 | Duan | B32B 27/00 383/211 |
| 2013/0177263 | A1 * | 7/2013 | Duan | B65D 75/5833 383/95 |

FOREIGN PATENT DOCUMENTS

| | | | |
|---|---|---|---|
| JP | 6-48475 | A | 2/1994 |
| JP | 6-293368 | A | 10/1994 |
| JP | 9-117387 | A | 5/1997 |
| JP | 9-202369 | A | 8/1997 |
| JP | 2002-160782 | A | 6/2002 |
| JP | 2004-182253 | A | 7/2004 |
| KR | 10-2011-0072735 | A | 6/2011 |

OTHER PUBLICATIONS

International Search Report issued in PCT/JP2013/061410, mailed on Aug. 6, 2013.

Singapore Search Report, issued Jul. 3, 2015, for Singapore Application No. 11201407745R.

* cited by examiner

PACKAGE BODY

TECHNICAL FIELD

The present invention relates to a package from which a packaged material contained therein is taken out.

BACKGROUND ART

Conventionally, a package is known from which packaged materials, such as wet sheets contained in a stacked state in a container, are taken out sequentially through a dispensing opening. The dispensing opening of such a package is generally covered with a re-adherable opening and closing flap.

However, repetition of opening and closing operations for performing opening and tight sealing by re-adhering using an ordinary opening and closing flap causes a ridge or a crease around the dispensing opening of the container and then worsens the tightly-sealed state with the opening and closing flap, resulting in a problem that the contained wet sheets tend to dry.

As a package that prevents a ridge or a crease around the dispensing opening of the container from easily occurring even if the operations are repeated, a packaging device described in patent literature 1 or a flap body described in patent literature 2 are known.

CITATION LIST

Patent Literature

Patent Literature 1: JP6-293368 A
Patent Literature 2: JP2002-160782 A

SUMMARY OF INVENTION

Technical Problem

The packaging device described in patent literature 1 is further provided with a shape-retaining sheet, an opening and closing flap is bonded on the shape-retaining sheet fixed to one face of an enclosure bag so that occurrence of a ridge or a crease around the dispending opening is restrained by the shape-retaining sheet. However, the packaging device described in patent literature 1 has no consideration to a root portion of the opening and closing flap when the opening and closing flap is lifted, and the opening and closing flap twists when the opening and closing flap is closed, and, after all, the tightly-sealed state worsens and the contained packaged materials dry.

The flap body described in patent literature 2, like the packaging device described in patent literature 1, is further provided with a reinforcing sheet, a covering sheet serving as a flap is bonded on the reinforcing sheet fixed to one face of the container, and, therefore, occurrence of a ridge or a crease around the dispending opening is restrained by the reinforcing sheet. However, in the flap body described in patent literature 2, the dispensing opening is endlessly formed, and perforations are formed in a root portion of the covering sheet when the covering sheet is lifted, so that the root portion is weak, and the covering sheet twists when the covering sheet is closed, and, after all, the tightly-sealed state worsens and the contained packaged materials dry.

Therefore, the present invention relates to providing a package that can eliminate the disadvantages which the above conventional techniques have.

Solution to Problems

The present invention relates to a package provided with a container containing a packaged material, a covering sheet fixed so as to cover a dispensing slot which is to be formed in the container and which is for taking out the packaged material, and a reseal label stuck to an upper face of the covering sheet so as to cover a dispensing slot which is to be formed in the covering sheet and which is for taking out the packaged material. The package has a first direction corresponding to an opening and closing direction of the reseal label, and a second direction orthogonal to the first direction. The reseal label has a fixed portion, which is fixed to the covering sheet, at one end portion side in the first direction, and a reseal portion capable of being peeled and lifted from the other end portion side of the reseal label in the first direction toward the fixed portion. The container has, on an upper face of the container, a container cutting line to form the dispensing slot of the container, on an upper face of the container, and the container cutting line is formed so as to project from the fixed portion side of the reseal label toward the other end portion side of the reseal label. The covering sheet has, outside the container cutting line, a covering-sheet cutting line to form the dispensing slot of the covering sheet and formed so as to project from the fixed portion side of the reseal label toward the other end portion side of the reseal label. When the reseal portion of the reseal label is lifted in a case of taking out the packaged material, a root portion of the reseal label has a three-layered portion including the reseal label, a separation piece of the covering sheet fixed to the reseal label and separated along the covering-sheet cutting line, and a separation piece of the container fixed to the separation piece of the covering sheet and separated along the container cutting line.

DESCRIPTION OF EMBODIMENTS

Figure 1:
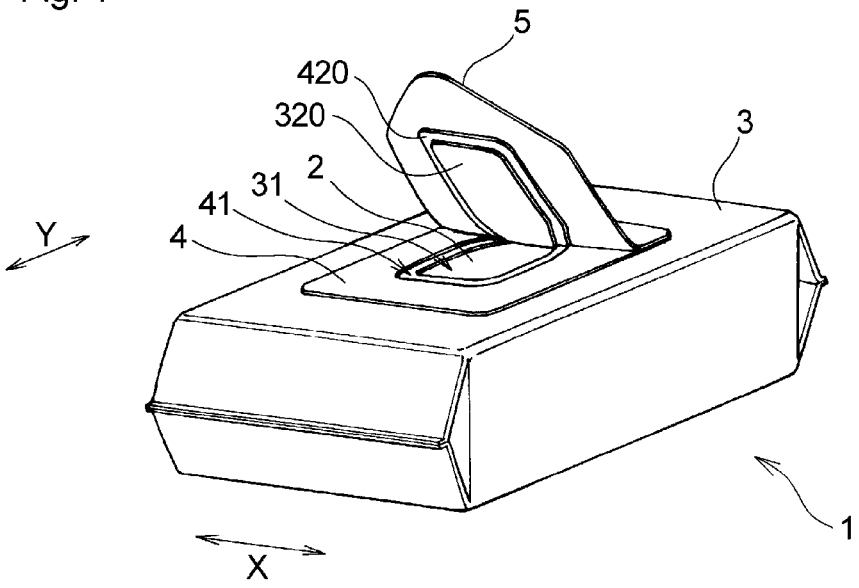
FIG. 1 is a perspective view of a package that is an embodiment of a package of the present invention.

Hereinbelow, a package of the present invention will be described with reference to FIG. 1 to FIG. 3 on the basis of a preferred embodiment thereof. FIG. 1 shows a perspective view of a package that is an embodiment of a package of the present invention, FIG. 2 shows an exploded perspective view of the package shown in FIG. 1, and FIG. 3 shows a plan view of the package as viewed from a top face of the package shown in FIG. 1.

Figure 2:
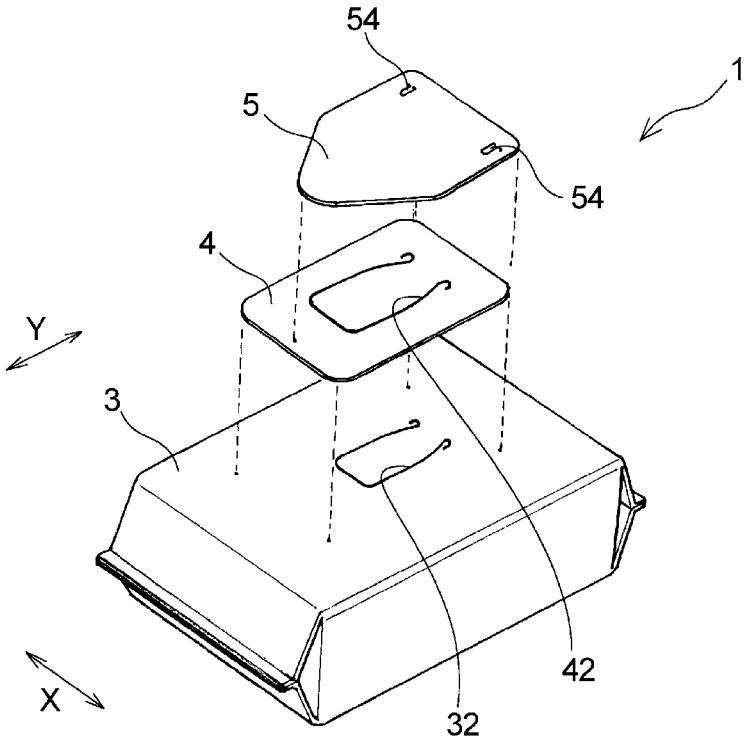
FIG. 2 is an exploded perspective view of the package shown in FIG. 1.
Figure 3:
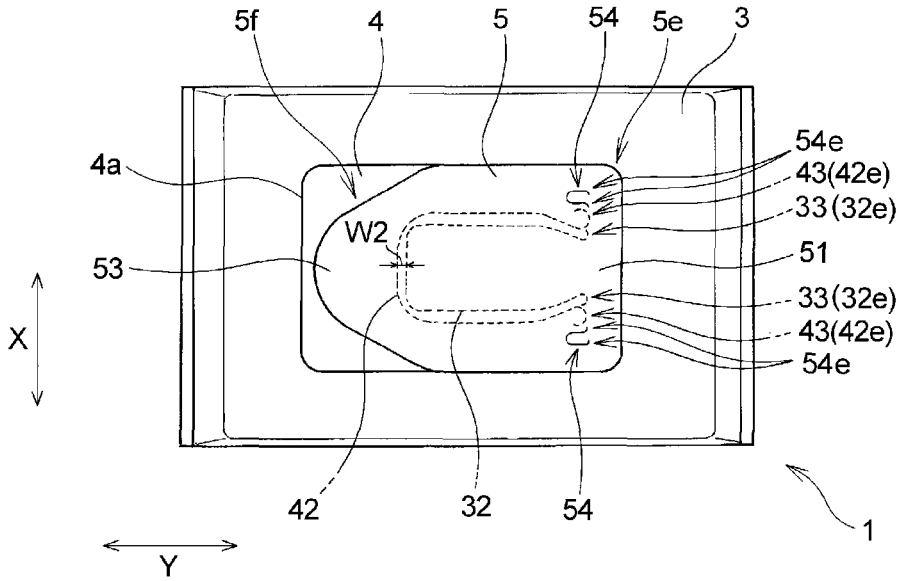
FIG. 3 is a plan view of the package shown in FIG. 1 as viewed from a top face of the package.

A package 1 of this embodiment, as shown in FIG. 1 to FIG. 3, is provided with a container 3 containing a packaged material 2, a covering sheet 4 fixed so as to cover a dispensing slot 31 which is to be formed in the container 3 and which is for taking out the packaged material 2, and a reseal label 5 stuck to an upper face of the covering sheet 4 so as to cover a discharging slot 41 which is to be formed in the covering sheet 4 and which is for taking out the packaged material 2. The packaged material 2 is a moistened sheet (called "wet sheet 2" below) impregnated with liquid, for example, and the container 3 contains a plurality of wet sheets 2 in a stacked state.

The package 1 is a package in which the discharging slot 31 of the container 3 and the discharging slot 41 of the covering sheet 4 are opened by peeling the reseal portion 52 of the reseal label 5 described later so that the wet sheets 2 in a stacked state contained in the container 3 can be taken out sequentially, for example, one by one through the discharging slot 31 of the container 3 and the discharging slot 41 of the covering sheet 4.

The package 1 of this embodiment has a first direction (Y direction in the respective figures) which is an opening and closing direction of repeating opening and closing of the reseal label 5, and a second direction (X direction in the respective figures) orthogonal to the first direction. An opening direction of the opening and closing direction means a direction in which the reseal label 5 is peeled by angle of 180°. The package 1 of this embodiment has a rectangular shape elongated in the Y direction in the figures in a plan view, before the wet sheet 2 is taken out. It should be noted that the package 1, the container 3, the covering sheet 4, and the reseal label 5 are described as being elongated in the Y direction, but the respective lengths in the Y direction and the X direction thereof may be equal to each other, or the length in the X direction thereof may be longer than the length in the Y direction.

Figure 4:
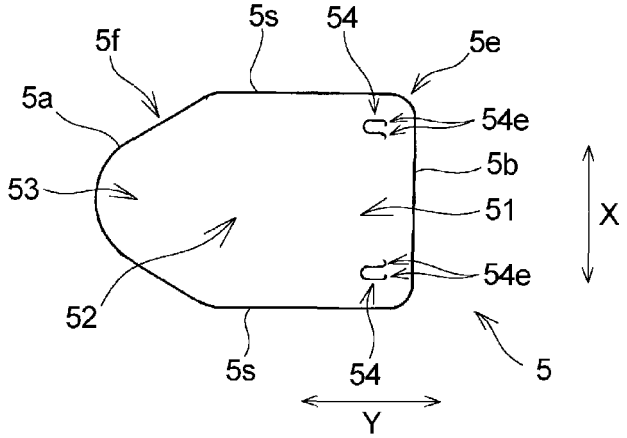
FIG. 4 is a plan view of a reseal label which the package shown in FIG. 1 has.

The reseal label 5 has a fixed portion 51, which is fixed to the covering sheet 4, at one end portion 5*e* side in the first direction (Y direction), and a reseal portion 52 capable of being peeled and lifted toward the fixed portion 51 from the other end portion 5*f* side in the first direction (Y direction). The reseal label 5 is opened toward the fixed portion 51 at the one end portion 5*e* side from the other end portion 5*f* side of the reseal label 5. Accordingly, the opening and closing direction of the reseal label 5 is identical to a direction from the other end portion 5*f* side of the reseal label 5 toward the fixed portion 51 at the one end portion 5*e* side. Further, since opening of the reseal label 5 is performed from the other end portion 5*f* side of the seal label 5 toward the one end portion 5*e* side, the other end portion 5*f* side of the reseal label 5 is also called "front side in the first direction (Y direction)" and the one end portion 5*e* side of the reseal label 5 is also called "rear side in the first direction (Y direction)" for descriptive purpose. FIG. 4 shows a plan view of the reseal label 5 which the package 1 shown in FIG. 1 has. The reseal label 5, as shown in FIG. 3, has a size capable of covering the discharging slot 41 of the covering sheet 4 described later, and, as shown in FIG. 4, has a front end edge 5*a* and a rear end edge 5*b* in the first direction (Y direction). In this regard, the front end edge 5*a*, as shown in FIG. 4, means a front edge in the first direction (Y direction) at the other end portion 5*f*, and defines the contour of a front side in the first direction (Y direction) of the reseal label 5. Further, the rear end edge 5*b* means a rear edge in the first direction (Y direction) at the one end portion 5*e*, and defines the contour of a rear side in the first direction (Y direction) of the reseal label 5. The front end edge 5*a*, as shown in FIG. 4, is formed so as to project outward (in a direction opposite to a direction toward the fixed portion 51) in the first direction (Y direction), and, at a central portion in the second direction (X direction), is formed in the shape of an arc projecting outward in the first direction (Y direction). The arc-shaped portion serves as a tab 53 pinched when the reseal portion 52 is peeled (opened). The rear end edge 5*b*, as shown in FIG. 4, extends linearly in the second direction (X direction). The length of the front end edge 5*a* in the second direction (X direction) and the length of the rear end edge 5*b* in the second direction (X direction) are the same.

Further, the reseal label 5 has a pair of lateral side edges 5*s*, 5*s* extending in the first direction (Y direction). The pair of lateral side edges 5*s*, 5*s* is parallel to each other, and extend in the first direction (Y direction). The lengths of the pair of lateral side edges 5*s*, 5*s* in the first direction (Y direction) are the same. In the other end portion 5*f*, an end edge of the front end edge 5*a* in the second direction (X direction) and an end edge of the lateral side edge 5*s* in the first direction (Y direction) are smoothly connected together, and, also in the other end portion 5*e*, an end edge of the rear end edge 5*b* in the second direction (X direction) and an end edge of the lateral side edge 5*s* in the first direction (Y direction) are smoothly connected together.

Further, the reseal label 5, in the package 1, is coated with a resealable adhesive agent over an entire lower face (a face facing the covering sheet 4) of the reseal label 5, and then is stuck to the upper face of the covering sheet 4. As the resealable adhesive agent, pressure-sensitive adhesives, such as polyester-based, acrylic, or rubber-based adhesives, generally used for the packages are involved. It should be noted that a lower face of the tab 53 is further coated with silicone or the like to become a non-sticking portion. Instead of coating with silicone or the like, it is also possible not to coat the lower face of the tab 53 with an adhesive agent in the first place.

Further, the reseal label 5, in the package 1, has a pair of notched portions 54, 54 at the one end portion 5*e* side. The pair of notched portions 54, 54 is provided at both side portions in the first direction (Y direction) of the reseal label 5. The pair of notched portions 54, 54, as shown in FIG. 3, is provided in substantially the same positions as both end portions 42*e*, 42*e* of a covering-sheet cutting line 42 to form the discharging slot 41 provided in the covering sheet 4 described later in the first direction (Y direction), and is provided in positions outside the both the end portions 42*e*, 42*e* in the second direction (X direction). Further, the pair of notched portions 54, 54, as shown in FIG. 3, is provided in substantially the same positions as both end portions 32*e*, 32*e* of a container cutting line 32 to form the discharging slot 31 provided in the container 3 in the first direction (Y direction), and is provided in positions outside the both the end portions 32*e*, 32*e* of the cutting line 32 in the second direction (X direction). Each notched portion 54, as shown in FIG. 4, is formed in an arc shape projecting toward the other end portion 5*f* (front in the first direction (Y direction)). Since such notched portions 54 are formed in a pair in the second direction (X direction), the adhesive agent causes portions within the notched portions 54 to stay on the covering sheet 4 when the reseal portion 52 is lifted, and the reseal portion 52 becomes unable to be lifted any further. Thus, the fixed portion 51 fixed to the covering sheet 4 is formed at the one end portion 5*e* of the reseal label 5. It is preferred that the radius of curvature of the arc-shaped notched portion 54 be 1 mm or more and 5 mm or less.

As the reseal label 5, a synthetic resin film single material or composite material of polyethylene, polypropylene, polyester, polyamide, or polyvinyl chloride, for example, or a laminate film made by bonding these synthetic resin films and an aluminum film or the like can be used.

Figure 5:
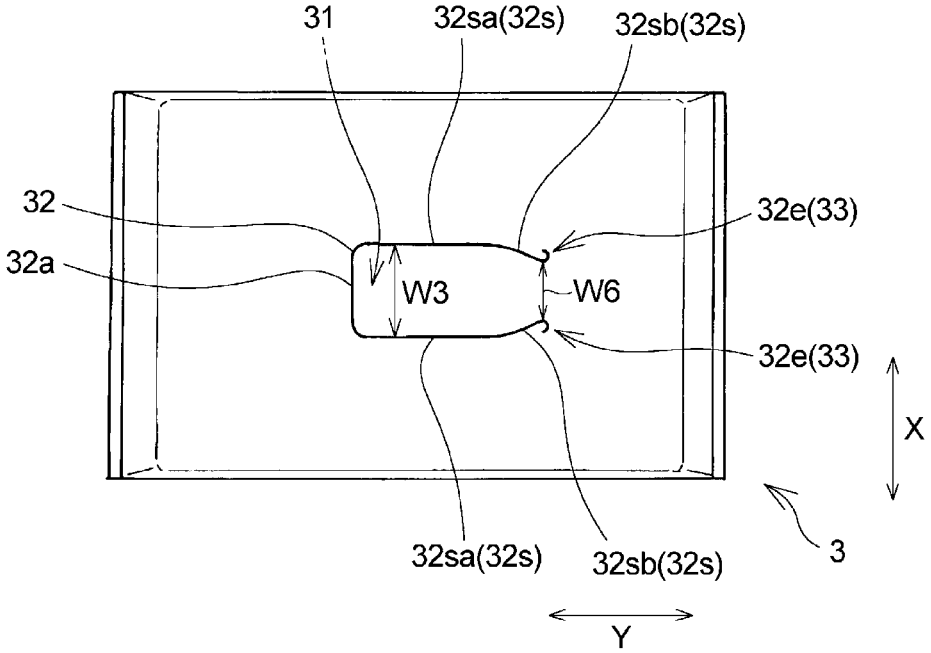
FIG. 5 is a plan view of a container which the package shown in FIG. 1 has.
Figure 6A:
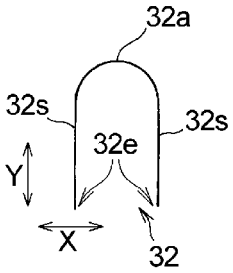
FIG. 6(*a*) to FIG. 6(*h*) are plan views of other shapes of a container cutting line provided in the container.
Figure 6B:
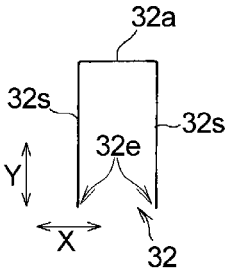
Figure 6C:
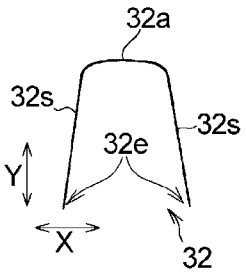
Figure 6D:
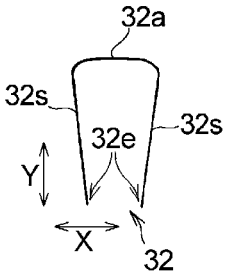
Figure 6E:
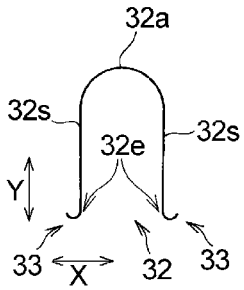
Figure 6F:
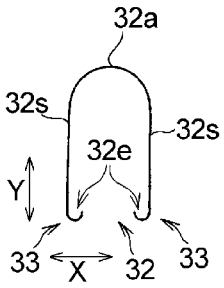
Figure 6G:
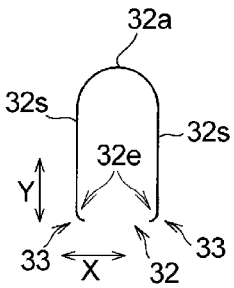
Figure 6H:
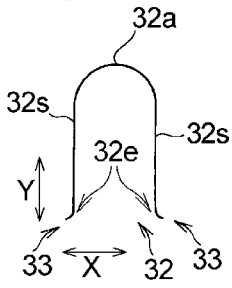

The container 3 has, on an upper face (face facing the covering sheet 4) of the container 3, the container cutting line 32 to form the dispensing slot 31 of the container 3, as shown in FIG. 2 and FIG. 5. As shown in FIG. 3, the container cutting line 32 is formed so as to project from the fixed portion 51 side of the reseal label 5 toward the other end portion 5*f* side of the reseal label 5. FIG. 5 shows a plan view of the container 3 which the package 1 shown in FIG. 1 has. As shown in FIG. 1, a portion separated by the container cutting line 32 of the container 3 becomes a separation piece 320.

The wet sheet 2 contained in the container 3 is a sheet material obtained by impregnating a fibrous material, such as nonwoven fabric, gauze, cotton, or paper, a flexible porous body, such as a sponge, or a composite material of these or a composite material of these and a film or the like, with liquid, such as cleansing liquid, washing liquid, wax, skin lotion, or beauty serum. A plurality (four or more and fifty or less) of wet sheets 2 are contained in a stacked state in the container 3. The wet sheets 2 in a stacked state are contained in the container 3 such that each wet sheet 2 is folded in a state where it overlaps with the upper and lower wet sheets 2, for example, and it can be taken out in a pop-up manner, or they are formed such that both end portions in the X direction of each wet sheet 2 are folded toward an upper face of the wet sheet 2, and further both end portions in the Y direction thereof are folded toward a lower face thereof, and the wet sheets 2 thus folded are stacked, for example. The stack of the wet sheets 2 is formed in a rectangular-cuboidal shape elongated in the first direction (Y) in a plan view.

The container 3, in the package 1, is formed in a rectangular shape in a plan view, as shown in FIG. 5, by covering the stack of the wet sheets 2 in a rectangular-cuboidal shape with a single sheet-like member, overlapping and bonding both edge portions in the first direction (Y direction) of the sheet-like member on a lower face side of the stack of the wet sheets 2 so that the sheet-like member 1 has a tubular shape with both end portions in the first direction (Y direction) opened, and sealing an upper face and an lower face of the sheet-like member at both the end portions. The stack of the wet sheets 2 is thus tightly sealed in the container 3.

Both the end portions 32*e*, 32*e* of the container cutting line 32 of the container 3, as shown in FIG. 5, are formed so as not to overlap with each other but to be separate from each other. The container cutting line 32, as shown in FIG. 5, has a front end edge 32*a* in the first direction (Y direction). The front end edge 32*a*, as shown in FIG. 5, extends linearly in the second direction (X direction). In this regard, both the end portions 32*e*, 32*e* of the container cutting line 32 define end portions of the cutting line 32 as a line, and the front end edge 32*a* defines a front portion in the first direction (Y direction) in a size enlargement shape of the container cutting line 32. Further, the container cutting line 32 has a pair of lateral side edges 32*s*, 32*s* extending in the first direction (Y direction). The lengths of the pair of lateral side edges 32*s*, 32*s* in the first direction (Y direction) are the same. The pair of lateral side edges 32*s*, 32*s* has a pair of first linear portions 32*sa*, 32*sa* extending mainly parallel to each other in the first direction (Y direction), and a pair of second linear portions 32*sb*, 32*sb* extending toward the one end portion 5*e* side (rear in the first direction (Y direction)) of the reseal label 5 continuously from the pair of first linear portions 32*sa*, 32*sa*. A distance in the second direction (X direction) between the pair of second linear portions 32*sb*, 32*sb*, as shown in FIG. 3 and FIG. 5, is gradually reduced from the other end portion 5*f* side (front in the first direction (Y direction)) toward the one end portion 5*e* side (rear in the first direction (Y direction)) of the reseal label 5. On the other end portion 5*f* side, an end edge, in the second direction (X direction), of the front end edge 32*a* and an end edge, in the first direction (Y direction), of the first linear portion 32*sa* of the lateral side edge 32*s* are smoothly jointed together. In view of cost, it is preferred that a distance between the pair of lateral side edges 32*s*, 32*s* of the container cutting line 32, namely, a distance W3 between the pair of first linear portions 32*sa*, 32*sa* in the package 1, be 25 mm or more and 35 mm or less. Further, in view of cost, and in order to prevent the reseal label 5 from easily twisting, it is preferred that a distance W6 between the pair of second linear portions 32*sb*, 32*sb* (distance between closest positions of the second linear portions 32) be 10 mm or more and 25 mm or less. From a viewpoint of blocking increase of the size of reseal label 5, the percentage of the distance W6 between the pair of second linear portions 32*sb*, 32*sb* to the distance W3 between the pair of first linear portions 32*sa*, 32*sa* (W6×100/W3) is preferably 30% or more, more preferably 40% or more, and preferably 100% or less, more preferably 70% or less, and preferably 30% or more and 100% or less, more preferably 40% or more and 70% or less.

In the package 1, as shown in FIG. 5, arc-shaped anti-tearing portions 33 are formed at both end portions 32*e*, 32*e* of the container cutting line 32 of the container 3, respectively. Each anti-tearing portion 33 is formed at an end portion of the second linear portion 32*sb* on the one end portion 5*e* side (rear in the first direction (Y direction)) of the reseal label 5, and is formed in the shape of an arc projecting toward the one end portion 5*e* side of the reseal label 5. It is preferred that the radius of curvature of the circular-arc-shaped anti-tearing portion 33 be 1 mm or more and 5 mm or less.

Further, as the container cutting line 32 formed so as to project toward the other end portion 5*f* side (front in the first direction (Y direction)), a shape other than the above-described shape shown in FIG. 5 may be adopted, and, for example, FIG. 6(*a*) to FIG. 6(*h*) show other shapes of the container cutting line 32 provided in the container 3. The container cutting lines 32 shown in FIG. 6(*a*) to FIG. 6(*h*) will be described below.

In the container cutting line 32 shown in FIG. 6(*a*), the front end edge 32*a* is formed in an arc shape projecting frontward in the first direction (Y direction), and the pair of lateral side edges 32*s*, 32*s* extends parallel to each other in the first direction (Y direction). Further, in the container cutting line 32, no anti-tearing portion 33 is formed at both the end portions.

In the container cutting line 32 shown in FIG. 6(*b*), the front end edge 32*a* extends linearly in the second direction (X), and the pair of lateral side edges 32*s*, 32*s* extend parallel to each other in the first direction (Y direction). Further, in the container cutting line 32, no anti-tearing portion 33 is formed at both the end portions.

In the container cutting line 32 shown in FIG. 6(*c*), the front end edge 32*a* extends so as to form an arc shape projecting frontward in the first direction (Y direction) and having a smaller radius of curvature than the front end edge 32*a* of the container cutting line 32 shown in FIG. 6(*a*), and the pair of lateral side edges 32*s*, 32*s* extends in the first direction (X direction) so as to gradually increase the mutual distance from the front side toward the rear side in the first direction (Y direction). Further, in the container cutting line 32, no anti-tearing portion 33 is formed at both the end portions.

In the container cutting line 32 shown in FIG. 6(*d*), the front end edge 32*a* extends so as to form an arc shape projecting frontward in the first direction (Y direction) and having a smaller radius of curvature than the front end edge 32*a* of the container cutting line 32 shown in FIG. 6(*a*), and the pair of lateral side edges 32*s*, 32*s* extends in the first direction (X direction) so as to gradually decrease the mutual distance from the front side toward the rear side in the first direction (Y direction). Further, in the container cutting line 32, no anti-tearing portion 33 is formed at both the end portions.

Further, in the container cutting line 32 shown in FIG. 6(*e*), the front end edge 32*a* is formed in an arc shape projecting frontward in the first direction (Y direction), and the pair of lateral side edges 32*s*, 32*s* extends parallel to each other in the first direction (Y direction). Further, the anti-tearing portions 33 are formed at both the end portions of the container cutting line 32, and each anti-tearing portion 33 is formed in a semi-circular shape projecting rearward in the first direction (Y direction) so as to face outward in the second direction (X direction).

In the container cutting line 32 shown in FIG. 6(*f*), the front end edge 32*a* is formed in an arc shape projecting frontward in the first direction (Y direction), and the pair of lateral side edges 32*s*, 32*s* extends parallel to each other in the first direction (Y direction). Further, the anti-tearing portions 33 are formed at both the end portions of the container cutting line 32, and each anti-tearing portion 33 is formed in a semi-circular shape projecting rearward in the first direction (Y direction) so as to face inward in the second direction (X direction).

In the container cutting line 32 shown in FIG. 6(*g*), the front end edge 32*a* is formed in an arc shape projecting frontward in the first direction (Y direction), and the pair of lateral side edges 32*s*, 32*s* extends parallel to each other in the first direction (Y direction). Further, the anti-tearing portions 33 are formed at both the end portions of the container cutting line 32, and each anti-tearing portion 33 is formed in an arc shape projecting rearward in the first direction (Y direction) so as to face inward in the second direction (X direction).

In the container cutting line 32 shown in FIG. 6(*h*), the front end edge 32*a* is formed in an arc shape projecting frontward in the first direction (Y direction), and the pair of lateral side edges 32*s*, 32*s* extends parallel to each other in the first direction (Y direction). Further, the anti-tearing portions 33 are formed at both the end portions of the container cutting line 32, and each anti-tearing portion 33 is formed in an arc shape projecting rearward in the first direction (Y direction) so as to face outward in the second direction (X direction).

As the sheet-like member forming the container 3, a well-known pillow film including an aluminum film layer, or a pillow film not including an aluminum film layer can be used, and, from a viewpoint of airtightness, it is preferred that a pillow film including an aluminum film layer be used. As the pillow film including an aluminum film layer, specifically, a laminate film can be used in which both front and back faces of an aluminum film layer are covered with synthetic resin film layers made of polyethylene, polypropylene, polyester, polyamide, polyvinyl chloride, or the like, for example. Patterns or letters can be drawn by printing or the like, if desired, on the front and back faces of the synthetic resin film layer that become external faces. Since such a sheet-like member including an aluminum film layer is used, drying of the wet sheets 2 contained in the container 3 can be restrained.

Figure 7:
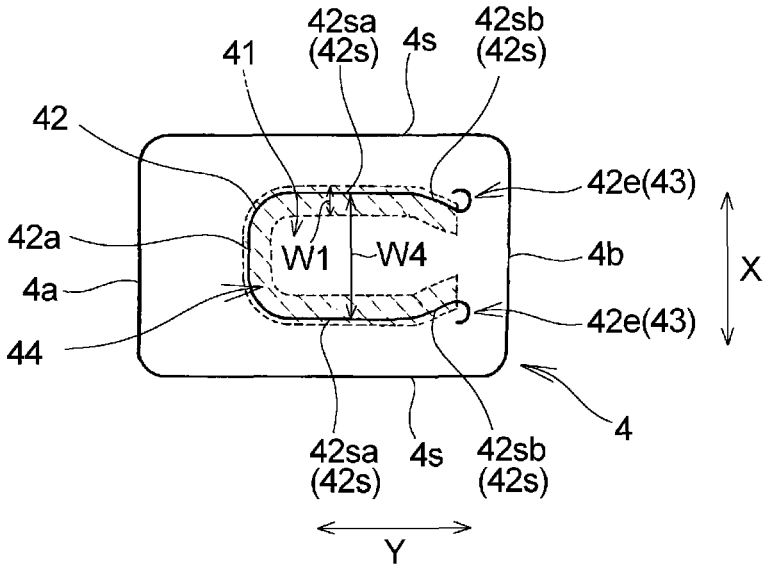
FIG. 7 is a plan view of a covering sheet which the package shown in FIG. 1 has.
Figure 8A:
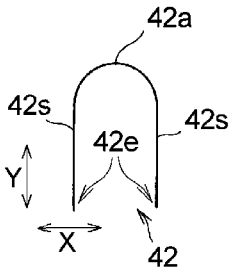
FIG. 8(*a*) to FIG. 8(*h*) are plan views of other shapes of a covering-sheet cutting line provided in the container.
Figure 8B:
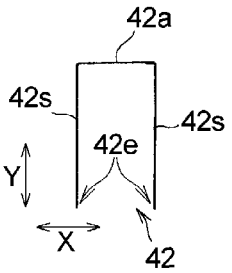
Figure 8C:
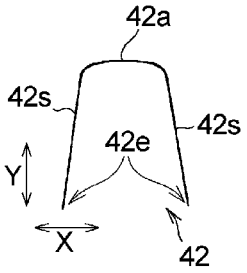
Figure 8D:
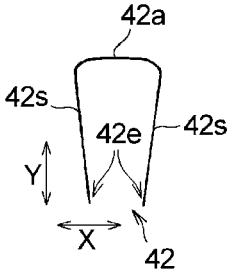
Figure 8E:
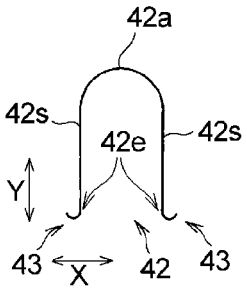
Figure 8F:
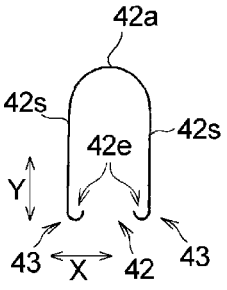
Figure 8G:
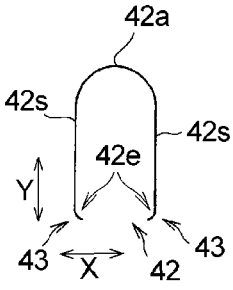
Figure 8H:
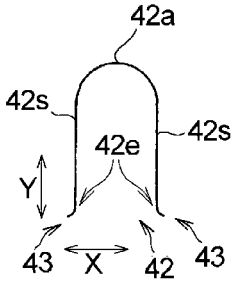

The covering sheet 4 is disposed between the reseal label 5 and the container 3. The covering sheet 4, as shown in FIG. 2 and FIG. 7, has the covering-sheet cutting line 42 to form the dispensing slot 41 of the covering sheet 4. The covering-sheet cutting line 42, as shown in FIG. 3, is formed so as to project from the fixed portion 51 side of the reseal label 5 toward the other end portion 5*f* side (front in the first direction (Y direction)) of the reseal label 5. FIG. 7 shows a plan view of the covering sheet 4 which the package 1 shown in FIG. 1 has. As shown in FIG. 1, a portion separated along the covering-sheet cutting line 42 of the covering sheet 4 becomes a separation piece 420.

The covering sheet 4, as shown in FIG. 3, has a size capable of covering the dispensing slot 31 of the container 3, and, as shown in FIG. 7, has a front end edge 4*a* and a rear end edge 4*b* in the first direction (Y direction). The front end edge 4*a* and the rear end edge 4*b* are parallel to each other, and extend in the second direction (X direction). The lengths of the front end edge 4*a* and the rear end edge 4*b* in the second direction (X direction) are the same. In the package 1, as shown in FIG. 3, the front end edge 4*a* of the covering sheet 4 is located outside the tab 53 formed at the front end edge 5*a* of the reseal label 5, and the rear end edge 4*b* of the covering sheet 4 and the rear end edge 5*b* of the reseal label 5 coincide with each other.

Further, the covering sheet 4, as shown in FIG. 7, has a pair of lateral side edges 4*s*, 4*s* extending in the first direction (Y direction). The pair of lateral side edges 4*s*, 4*s* is parallel to each other and extend in the first direction (Y direction). The lengths of the pair of lateral side edges 4*s*, 4*s* in the first direction (Y direction) are the same. In the package 1, as shown in FIG. 3, the formation positions of both the lateral side edges 4*s*, 4*s* of the covering sheet 4 coincide with the formation positions of both the lateral side edges 5*s*, 5*s* of the reseal label 5. On the other end portion 5*f* side of the reseal label 5, an end edge, in the second direction (X direction), of the front end edge 4*a* and an end edge, in the first direction (Y direction), of the lateral side edge 4*s* are smoothly jointed to each other, and also on the one end portion 5*e* side of the reseal label 5, an end edge, in the second direction (X direction), of the rear end edge 4*b* and an end edge, in the first direction (Y direction), of the lateral side edge 4*s* are smoothly jointed to each other.

Further, in the package 1, a lower face (face opposite to the container 3) of the covering sheet 4 is coated with an adhesive agent, and the covering sheet 4 is fixed to the upper face of the container 3. As a fixable adhesive agent, a hot-melt adhesive, which is generally used for the package is involved. The fixable adhesive agent generally has higher adhesive strength than a resealable adhesive agent that is applied to the reseal label 5. It should be noted that, instead of an adhesive agent, a heat seal may be used to perform fixing the covering sheet 4 to the upper face of the container 3.

As described above, the lower face (face opposite the container 3) of the covering sheet 4 is coated with the adhesive agent, but, in the package 1, a non-sticking portion 44 is formed on the lower face (face facing the container 3) of the covering sheet 4 along the covering-sheet cutting line 42 described later. The non-sticking portion 44 extends along the covering-sheet cutting line 42, includes the covering-sheet cutting line 42, and is formed in a strip shape. It is preferred that a width W1 of the strip-shaped non-sticking portion 44 be 5 mm or more and 12 mm or less. The non-sticking portion 44 is formed applying no adhesive agent to the lower face of the covering sheet 4, or the non-sticking portion 44 is formed by applying an adhesive agent to the entire lower face of the covering sheet 4, and then applying silicone or varnish to a strip shape including the covering-sheet cutting line 42.

The covering sheet 4, in the package 1, as shown in FIG. 3, has, outside the container cutting line 32 of the container 3, the covering-sheet cutting line 42 which has a substantially similar shape to the shape of the container cutting line 32 of the container 3 and which is to form the dispensing slot 41. The covering-sheet cutting line 42 is formed so as to project from the fixed portion 51 side of the reseal label 5 toward the other end portion 5*f* side (front in the first direction (Y direction)), and both the end portions 42*e*, 42*e* of the covering-sheet cutting line 42 are formed so as not to overlap with each other but to be separate from each other. The covering-sheet cutting line 42, as shown in FIG. 7, has the front end edge 42*a* in the first direction (Y direction). In this regard, both the end portions 42*e*, 42 of the covering-sheet cutting line 42 define line end portions of the covering-sheet cutting line 42, and the front end edge 42*a* defines a front portion in the first direction (Y direction) in the size enlargement shape of the covering-sheet cutting line 42. The front end edge 42*a*, as shown in FIG. 7, extends linearly in the second direction (X direction). The front end edge 42*a* of the covering-sheet cutting line 42, as shown in FIG. 3, is disposed outside the front end edge 32*a* of the container cutting line 32 of the container 3 in the first direction (Y direction), and it is preferred that a distance W2 between the front end edge 42*a* of the covering-sheet cutting line 42 and the front end edge 32*a* of the container cutting line 32 be 1 mm or more and 3 mm or less.

Further, the covering-sheet cutting line 42 has a pair of end edges 42*s*, 42*s* extending in the first direction (Y direction). The lengths of the pair of lateral side edges 42*s*, 42*s* in the first direction (Y direction) are the same. The pair of lateral side edges 42*s*, 42*s* has a pair of first linear portions 42*sa*, 42*sa* extending mainly parallel to each other in the first direction (Y direction), and a pair of second linear portions 42*sb*, 42*sb* extending on the one end portion 5*e* side (rear in the first direction (Y direction)) of the reseal label 5 continuously from the pair of first linear portions 42*sa*, 42*sa*. A distance in the second direction (X direction) between the pair of second linear portions 42*sb*, 42*sb*, as shown in FIG. 7, is gradually reduced from the other end portion 5*f* side toward the one end portion 5*e* of the reseal label 5. On the other end portion 5*f* side, an end edge in the second direction (X direction) of the front end edge 42*a* and an end edge in the first direction (Y direction) of the first linear portion 42*sa* of the lateral side edge 42*s* are smoothly jointed together. The pair of lateral side edges 42*s*, 42*s* of the covering-sheet cutting line 42 is disposed outside the pair of lateral side edges 32*s*, 32*s* of the container cutting line 32 in the second direction (X direction), and, regarding a distance between the pair of lateral side edges 42*s*, 42*s* of the covering-sheet cutting line 42, it is preferred that a distance W4 between the pair of first linear portions 42*sa*, 42*sa* be 25 mm or more and 45 mm or less.

In the package 1, as shown in FIG. 7, arc-shaped anti-tearing portions 43 are formed at both the end portion 42*e*, 42*e* of the covering-sheet cutting line 42 of the covering sheet 4. Each anti-tearing portion 43 has a generally similar shape to the shape of the anti-tearing portion 33 of the container cutting line 32 of the container 3, is formed at an end portion of the second linear portion 42*sb* on the one end portion 5*e* side (rear in the first direction (Y direction)) of the reseal label 5, and is formed in an arc shape projecting toward the one end portion 5*e* side of the reseal label 5. It is preferred that the radius of curvature of the circular-arc-shaped anti-tearing portion 43 be 1 mm or more and 5 mm or less.

Further, as the covering-sheet cutting line 42 formed so as to project toward the other end portion 5*f* side (front in the first direction (Y direction)), a shape other than the above-described shape shown in FIG. 7 may be adopted, and, for example, FIG. 8(*a*) to FIG. 8(*h*) show other shapes of the covering-sheet cutting line 42 provided in the covering sheet 4. The covering-sheet cutting lines 42 shown in FIG. 8(*a*) to FIG. 8(*h*) will be described below.

In the covering-sheet cutting line 42 shown in FIG. 8(*a*), the front end edge 42*a* is formed in an arc shape projecting frontward in the first direction (Y direction), and the pair of lateral side edges 42*s*, 42*s* extends parallel to each other in the first direction (Y direction). Further, in the covering-sheet cutting line 42, no anti-tearing portion 43 is formed at both the end portions.

In the covering-sheet cutting line 42 shown in FIG. 8(*b*), the front end edge 42*a* extends linearly in the second direction (X direction), and the pair of lateral side edges 42*s*, 42*s* extends parallel to each other in the first direction (Y direction). Further, in the covering-sheet cutting line 42, no anti-tearing portion 43 is formed at both the end portions.

In the covering-sheet cutting line 42 shown in FIG. 8(*c*), the front end edge 42*a* extends so as to form an arc shape projecting frontward in the first direction (Y direction) and having a smaller radius of curvature than the front end edge 42*a* of the covering-sheet cutting line 42 shown in FIG. 8(*a*), and the pair of lateral side edges 42*s*, 42*s* extends in the first direction (X direction) so as to gradually increase the mutual distance from the front side toward the rear side in the first direction (Y direction). Further, in the covering-sheet cutting line 42, no anti-tearing portion 43 is formed at both the end portions.

In the covering-sheet cutting line 42 shown in FIG. 8(*d*), the front end edge 42*a* extends so as to form an arc shape projecting frontward in the first direction (Y direction) and having a smaller radius of curvature than the front end edge 42*a* of the covering-sheet cutting line 42 shown in FIG. 8(*a*), and the pair of lateral side edges 42*s*, 42*s* extends in the first direction (X direction) so as to gradually decrease the mutual distance from the front side toward the rear side in the first direction (Y direction). Further, in the covering-sheet cutting line 42, no anti-tearing portion 43 is formed at both the end portions.

Further, in the covering-sheet cutting line 42 shown in FIG. 8(*e*), the front end edge 42*a* is formed in an arc shape projecting frontward in the first direction (Y direction), and the pair of lateral side edges 42*s*, 42*s* extends parallel to each other in the first direction (Y direction). Further, the anti-tearing portions 43 are formed at both the end portions of the covering-sheet cutting line 42, and each anti-tearing portion 43 is formed in a semicircular shape projecting rearward in the first direction (Y direction) so as to face outward in the second direction (X direction).

In the covering-sheet cutting line 42 shown in FIG. 8(*f*), the front end edge 42*a* is formed in an arc shape projecting frontward in the first direction (Y direction), and the pair of lateral side edges 42*s*, 42*s* extends parallel to each other in the first direction (Y direction). Further, the anti-tearing portions 43 are formed at both the end portions of the covering-sheet cutting line 42, and each anti-tearing portion 43 is formed in the shape of a semicircle curving rearward in the first direction (Y direction) so as to face inward in the second direction (X direction).

In the covering-sheet cutting line 42 shown in FIG. 8(*g*), the front end edge 42*a* is formed in an arc shape projecting frontward in the first direction (Y direction), and the pair of lateral side edges 42*s*, 42*s* extends parallel to each other in the first direction (Y direction). Further, the anti-tearing portions 43 are formed at both the end portions of the covering-sheet cutting line 42, and each the anti-tearing portion 43 is formed in an arc shape projecting rearward in the first direction (Y direction) so as to face inward in the second direction (X direction).

In the covering-sheet cutting line 42 shown in FIG. 8(*h*), the front end edge 42*a* is formed in an arc shape projecting frontward in the first direction (Y direction), and the pair of lateral side edges 42*s*, 42*s* extends parallel to each other in the first direction (Y direction). Further, the anti-tearing portions 43 are formed at both the end portions of the covering-sheet cutting line 42, and each anti-tearing portion 43 is formed in an arc shape projecting rearward in the first direction (Y direction) so as to face outward in the second direction (X direction).

It is preferred that the covering-sheet cutting lines 42 of the covering sheet 4 shown in FIG. 8(*a*) to FIG. 8(*h*) be substantially similar in shape to the container cutting lines 32 of the container 3 shown in FIG. 6(*a*) to FIG. 6(*h*), but if it is possible to dispose the covering-sheet cutting lines 42 outside the container cutting lines 32 of the container 3, the shapes of the covering-sheet cutting lines 42 can be combined with any shape.

As the covering sheet 4, a synthetic resin film single material of polyethylene, polypropylene, polyester, polyamide, or polyvinyl chloride, for example, or composite material thereof which his generally used for package, can be used. From a viewpoint of preventing a ridge or a crease from easily occurring around the dispensing openings 31, 41, a sheet-like member forming the covering sheet 4 preferably has higher rigidity than the sheet-like member forming the reseal label 5, and more preferably has higher rigidity than the sheet-like member forming the container 3.

In the package 1, as shown in FIG. 3, in the first direction (Y direction), the positions of both the end portions 32*e*, 32*e* of the container cutting line 32 of the container 3 are coincident with the positions of both the end portions 42*e*, 42*e* of the covering-sheet cutting line 42 of the covering sheet 4, and is also coincident with the position of each end 54*e* of the pair of circular-arc-shaped notched portions 54, 54 of the reseal label 5. Since the positions of both the end portions 32*e*, 32*e* and the positions of both the end portions 42*e*, 42*e* are coincident with each other in the first direction (Y direction), the pillow film can be prevented from being torn when the reseal label is opened, and further, since the positions of both the end portions 32*e*, 32*e* are also coincident with the position of each end 54*e* of the notched portions 54, 54, the pillow film can be further prevented from being torn when the reseal label is opened.

Figure 10:
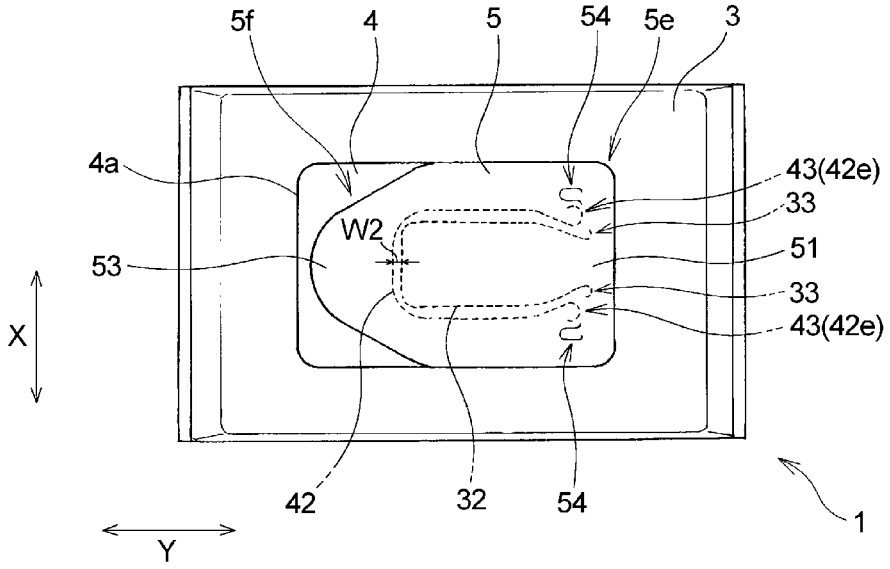
FIG. 10 is a plan view of the package that is another embodiment of the package of the present invention, as viewed from a top face of the package (corresponding to FIG. 3).

It should be noted that the positions of both the end portions 32*e*, 32*e* of the container cutting line 32, as shown in FIG. 10, may be disposed closer to the one end portion 5*e* side (rear in the first direction (Y direction)) of the reseal label 5 in the first direction (Y direction)) than the positions of both the end portions 42*e*, 42*e* of the covering-sheet cutting line 42. In such as case, the anti-tearing portion 33 does not need to be provided at both the end portions 32*e*, 32*e* of the container cutting line 32, but it is preferred that the ant-tearing portion 33 be provided when the reseal label 5 is opened and closed many times. Further, the positions of both the end portions 32*e*, 32*e* of the container cutting line 32 may be disposed closer to the other end portion 5*f* side (front side in the first direction (Y direction)) of the reseal label 5 in the first direction (Y direction) than the positions of both the end portions 42*e*, 42*e* of the covering-sheet cutting line 42. In such a case, it is preferred that the anti-tearing portion 33 be provided at both the end portions 32*e*, 32*e* of the container cutting line 32.

A case where the wet sheet 2 that is a packaged material and is contained in the package 1 is taken out of the package 1 described above will be described below.

Figure 9:
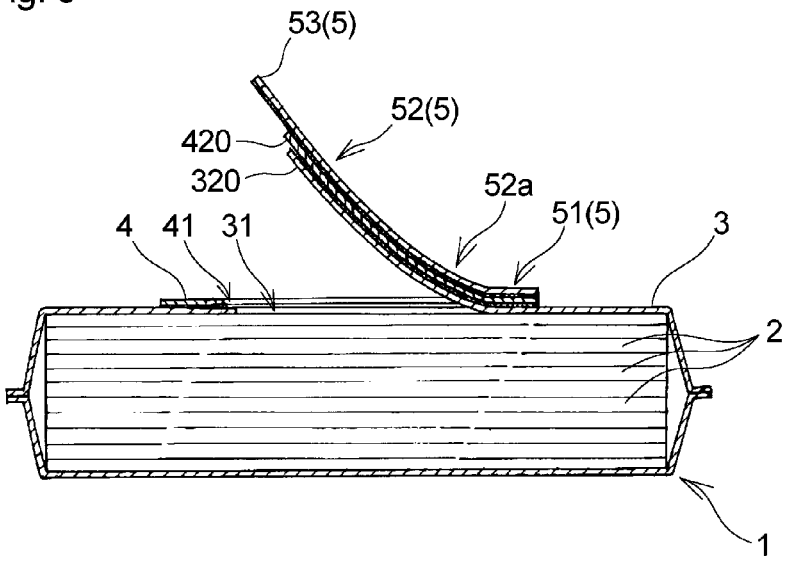
FIG. 9 is a sectional view when a reseal portion of a reseal label which the package shown in FIG. 1 has been lifted.

As shown in FIG. 1, in a case where the package 1 is opened and when the wet sheet 2 is taken out from the package 1, the reseal portion 52 of the reseal label 5 is peeled and lifted, a root portion 52*a* of the reseal portion 52, as shown in FIG. 9, has a three-layered portion, the three-layered portion, in a sectional view, being composed of the reseal label 5, the separation piece 420 of the covering sheet 4 which is separated along the covering-sheet cutting line 42 and is fixed to the reseal label 5, and the separation piece 320 of the container 3 which is separated along the container cutting line 32 and is fixed to the separation piece 420 of the covering sheet 4. Specifically, when the reseal portion 52 of the reseal label 5 is lifted when taking out the wet sheet 2, since the positions of both the end portions 32*e*, 32*e* of the container cutting line 32 of the container 3, the positions of both the end portions 42*e*, 42*e* of the covering-sheet cutting line 42 of the covering sheet 4, and the positions of both the ends 54*e* of the pair of notched portions 54, 54 of the reseal label 5 are coincident with each other in the first direction (Y direction), as shown in FIG. 3, the pair of notched portions 54, 54 of the reseal label 5, the anti-tearing portion 43 of the covering sheet 4, and the anti-tearing portion of the container 3 prevent the reseal label 5 from being peeled any further when the reseal portion 52 of the reseal label 5 is lifted when taking out the wet sheet 2, as shown in FIG. 1. Then, by peeling the reseal portion 52 of the reseal label 5, the separation piece 420 of the covering sheet 4 is formed along the covering-sheet cutting line 42 in the covering sheet 4, and the separation piece 320 of the container 3 is formed along the container cutting line 32 in the upper face of the container 3. Therefore, the separation piece 420 of the covering sheet 4, which is separated along the covering-sheet cutting line 42 provided in the covering sheet 4, is fixed to a lower face of the reseal portion 52 of the reseal label 5, and the separation piece 320 of the container 3, which is separated along the container cutting line 32 provided in the upper face of the container 3, is fixed to a lower face of the separation piece 420 of the covering sheet 4. These fixations are not peeled off even according to the opening and closing operation of the reseal label 5.

In the package 1, as shown in FIG. 1, since the covering sheet 4 is fixed so as to cover the dispensing slot 31 formed in the container 3, a ridge or a crease around the dispensing openings 31, 41 is not easily caused even if opening and closing operations are repeated using the reseal label 5, so that the tightly-sealed state of the package 1 can be well maintained. Further, in the package 1, as shown in FIG. 9, since the root portion 52*a* of the reseal portion 52 has a three-layered portion composed of the reseal label 5, the separation piece 420 of the covering sheet 4, and the separation piece 320 of the container 3, the reseal label 5 is further prevented from easily twisting when the package 1 is tightly sealed with the reseal label 5, so that the tightly-sealed state of the package 1 is improved.

Further, since the three-layered portion composed of the reseal label 5, the separation piece 420 of the covering sheet 4, and the separation piece 320 of the container 3 is continuous from the reseal portion 52 to the fixed portion 51 of the reseal label 5 via the root portion 52*a*, the reseal label 5 is further prevented from easily twisting when the package 1 is tightly sealed with the reseal label 5, so that the tightly-sealed state of the package 1 is improved.

In the package 1, as shown in FIG. 7, since the strip-like non-sticking portion 44 is formed along the covering-sheet cutting line 42 on the lower face of the covering sheet 4, the separation piece 420 of the covering sheet 4 can be easily lifted along the covering-sheet cutting line 42 when the reseal label 5 is opened.

Further, in the package 1, since the strip-like non-sticking portion 44 is present on the lower face of the covering sheet 4, even if a positional deviation occurring when the reseal label 5 and the covering sheet 4 are stuck to the container is present or a positional deviation occurring when the separation piece 320 of the container 3 is processed is present, the strip-like non-sticking portion 44 provided on the lower face of the covering sheet 4 allows the separation piece 420 of the covering sheet 4 and the separation piece 320 of the container 3 to be lifted in the three-layered state when the reseal label 5 is opened.

The package of the present invention is not limited to the package 1 described above, but can be modified if necessary.

For example, in the package 1 described above, the wet sheets 2 are contained in the container 3, but the package 1 may be a package containing tissues or papers applied with a volatile fragrance.

Further, in the package 1 described above, as shown in FIG. 4, the fixed portion 51 is formed by providing the pair of notched portions 54, 54, but, instead of the pair of notched portions 54, 54, the fixed portion 51 may be formed by applying an adhesive agent having higher adhesive strength than a resealable adhesive agent, for example, an adhesive applied to the covering sheet 4.

Further, in the package 1 described above, though the arc-shaped anti-tearing portions 33 are provided at both the end portions 32*e*, 32*e* of the container cutting line 32 of the container 3 (see FIG. 5), respectively, and the arc-shaped anti-tearing portions 43 are provided at both the end portions 42*e*, 42*e* of the covering-sheet cutting line 42 of the covering sheet 4 (see FIG. 7), respectively. However, the shape of the anti-tearing portion 33 or the anti-tearing portion 43 is not limited to the arc shape, and may be a curved shape or a linear shape, or a combination of these shapes, for example. Further, the anti-tearing portion 33 or the anti-tearing portion 43 may be formed in a small circular opening and, in this case, this opening, the container cutting line 32, and the covering-sheet cutting line 42 form a continuous shape. In short, it is preferred that the anti-tearing portions 33, 43 have a tangent orthogonal to the opening direction such that the anti-tearing portions 33, 43 can receive opening force in a different direction from the opening direction when the reseal label 5 is opened, and further it is preferred that the anti-tearing portions 33, 43 be cut into a shape directed back in the opening direction. It is preferred that a portion directed in a different direction from the opening direction be curved. Further, if the anti-tearing portions 33, 43 have a shape formed by combing an arc or a curve or a straight line, it is preferred, from a viewpoint of prevention of tearing of the pillow film, that each of the shapes be smoothly connected together since the force occurring when the reseal label 5 is opened can be distributed.

Further, in the package 1 described above, the reseal label 5 has the arc-shaped notched portion 54 (see FIG. 4), but the shape of the notched portion 54 is not limited to the arc shape, but may be curved, linear, or a shape formed by combining a curve and a straight line.

The wet sheet 2 can be used for cleaning or skin wiping, or as a wiper for a baby or an adult, skin lotion, facial mask, makeup remover, or the like.

It should be noted the reseal label 5 and the covering sheet 4 in a stacked state thereof are bonded to the container 3 in view of cost. Specifically, the reseal label 5 and the covering sheet 4 are not separately bonded to the container 3, but the reseal label 5 and the covering sheet 4 in a combined state are bonded to the container. Regarding the timing of bonding, the reseal label 5 and the covering sheet 4 may be bonded to the strip-like sheet-like member before forming the container 3, or may be bonded to the container after the stack of the wet sheets 2 is covered with the sheet-like member and is tightly sealed in the container 3.

In addition to the embodiment described above, another embodiment will be described below. Regarding a package described below (also called "package 1B" below), differences from the package 1 described above are described. The package described below is the same as the package 1, unless otherwise described, and the description of the package 1 is applied to the package described below, if necessary. Further, in FIG. 11 and FIG. 15, same members as in FIG. 1 to FIG. 9 are denoted by same reference signs.

Figure 11:
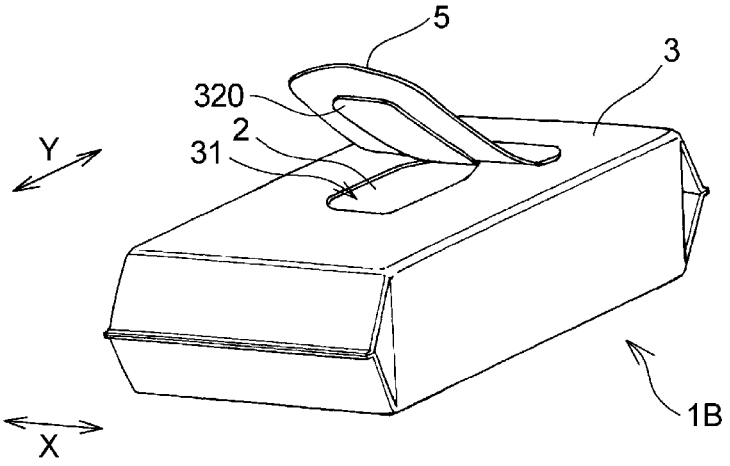
FIG. 11 is a perspective view of another package.
Figure 12:
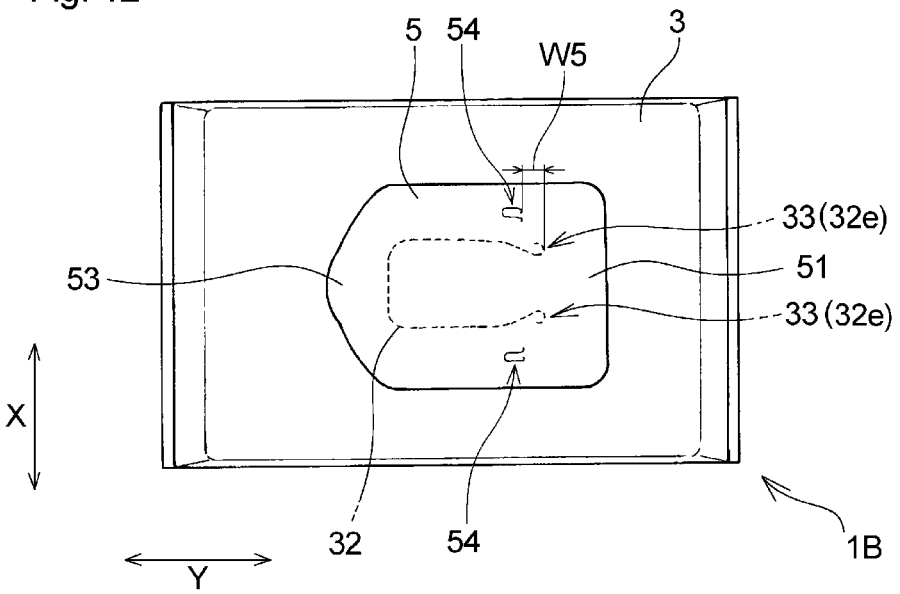
FIG. 12 is a plan view of the package shown in FIG. 11, as viewed from a top face of the package.

FIG. 11 shows a perspective view of the package 1B, and FIG. 12 shows a plan view of the package 1B shown in FIG. 11 as viewed from above.

The package 1B, as shown in FIG. 11 and FIG. 12, is provided with a container 3 containing a plurality of wet sheets 2 in a stacked state as a packaged material, and a reseal label 5 stuck so as to cover a dispensing slot 31 for taking out the wet sheet 2 formed in the container 3.

The package 1B is a package in which the discharging slot 31 of the container 3 is opened by peeling the reseal portion 52 of the reseal label 5 described later so that the wet sheets 2 in a stacked state contained in the container 3 can be taken out sequentially one by one, for example, through the discharging slot 31 of the container 3.

Figure 13:
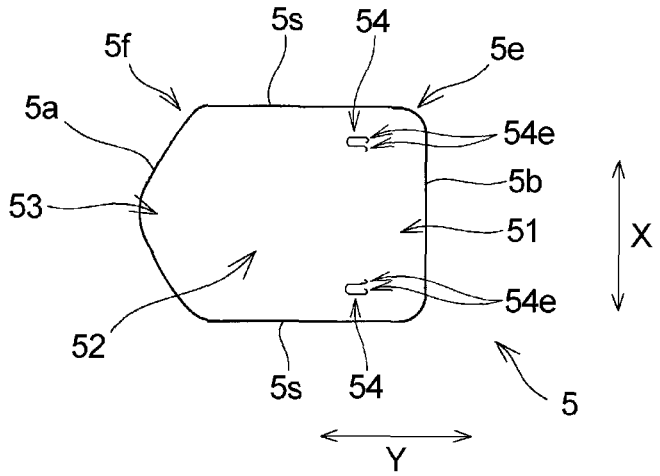
FIG. 13 is a plan view of a reseal label which the package shown in FIG. 11 has.

FIG. 13 shows a plan view of a reseal label which the package 1B shown in FIG. 11 has. The reseal label 5, as shown in FIG. 13, has a size capable of covering the discharging slot 31 of the container 3 described later. The reseal label 5, in the package 1B, has a pair of notched portions 54, 54 at both side portions in the first direction (Y direction). The pair of notched portions 54, 54, as shown in FIG. 13, is formed in an arc shape projecting toward the other end portion 5*f* side (frontward in the first direction (Y direction)). The pair of notched portions 54, 54, as shown in FIG. 12, is provided outside both end portions 32*e*, 32*e* of a container cutting line 32 to form the dispensing slot 31 provided in the container 3 in the second direction (X direction).

Figure 14:
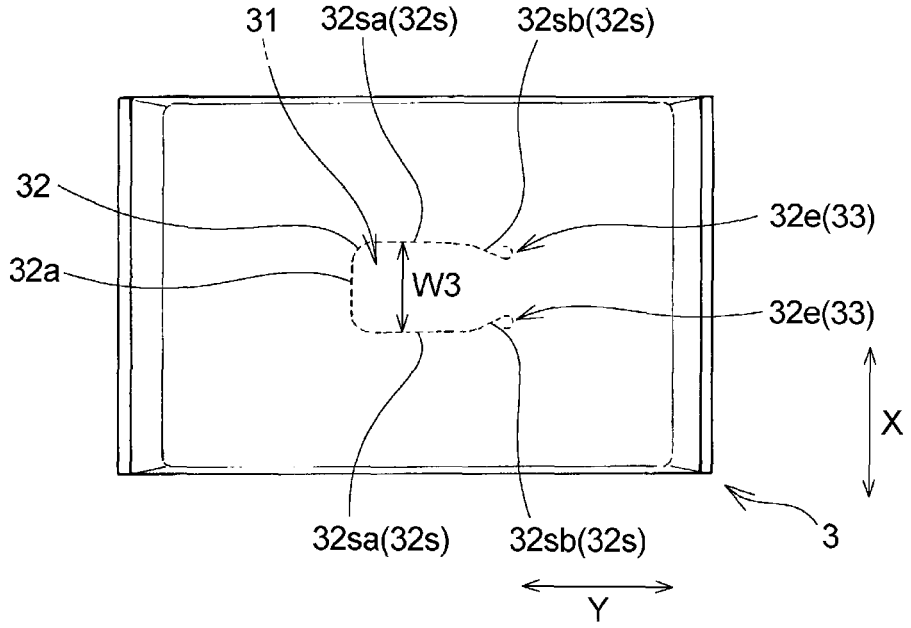
FIG. 14 is a plan view of a container which the package shown in FIG. 11 has.

FIG. 14 shows a plan view of the container 3 which the package 1B shown in FIG. 11 has. The container 3 has, on an upper face (face facing the covering sheet 4) of the container 3, a container cutting line 32 to form the dispensing slot 31 of the container 3. The container cutting line 32 is formed so as to project from a fixed portion 51 side of the reseal label 5 toward the other end portion 5*f* side (front side in the first direction (Y direction)), and both end portions 32*e*, 32*e* of the container cutting line 32 are formed so as not to overlap with each other but to be separate from each other. Anti-tearing portions 33 are formed at both the end portion 32*e*, 32*e* of the container cutting line 32 of the container 3, respectively. Each anti-tearing portion 33 is formed in an arc shape projecting toward one end portion 5*e* side (rear in the first direction (Y direction)) of the reseal label 5. The container cutting line 32 may have a different shape from the above-described shape shown in FIG. 14, and may have, for example, the shapes shown in FIG. 6(*a*) to FIG. 6(*h*), as in the case of the package 1.

In the package 1B, as shown in FIG. 12, the positions of both the end portions 32*e*, 32*e* of the container cutting line 32 of the container 3 are disposed behind the positions of the pair of circular-arc-shaped notched portions 54, 54 of the reseal label 5 in the first direction (Y direction). Specifically, rearward vertexes in the first direction (Y direction) of the arc-shaped anti-tearing portions 33 of both the end portions 32*e*, 32*e* of the container cutting line 32 are disposed behind rearward vertexes in the first direction (Y direction) of the pair of arc-shaped notched portions 54, 54 of the reseal label 5. A distance W5 between the rearward vertexes in the first direction (Y direction) of the anti-tearing portion 33 and the rearward vertexes in the first direction (Y direction) of the pair of arc-shaped notched portions 54, 54 is preferably 0 mm or more and 5 mm or less, and more preferably more than 0 mm and 5 mm or less.

Figure 15:
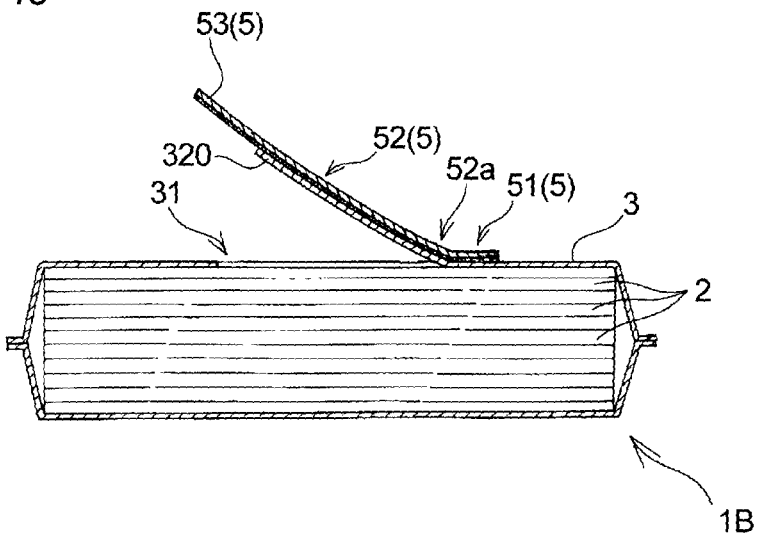
FIG. 15 is a sectional view of the package when a reseal portion of a reseal label, which the package shown in FIG. 11 has, has been lifted.

A case where the wet sheet 2 contained is taken out from the package 1B described above will be described below. FIG. 15 shows a sectional view of the package when the reseal portion 52 of the reseal label 5 which the package 1B has is lifted.

When the reseal portion 52 of the reseal label 5 is lifted when taking out the wet sheet 2, a root portion 52*a* of the reseal portion 52 is composed of, in a sectional view, the reseal label 5 and a separation piece 320 of the container 3 fixed to the reseal label 5 and separated along the container cutting line 32, as shown in FIG. 15. Specifically, when the reseal portion 52 of the reseal label 5 is lifted when taking out the wet sheet 2, since the positions of both the end portions 32*e*, 32*e* of the container cutting line 32 of the container 3 are disposed behind the positions of both the ends 54*e* of the pair of arc-shaped notched portions 54, 54 of the reseal label 5 in the first direction (Y direction), as shown in FIG. 12, peeling of the reseal label 5 is prevented by the notched portions 54, 54 that are the anti-tearing portions of the reseal label 5. Then, according to lifting of the reseal portion 52 of the reseal label 5, the separation piece 320 of the container 3 is formed along the container cutting line 32 in an upper face of the container 3. Therefore, the separation piece 320 of the container 3 disposed in the upper face of the container 3 and separated along the container cutting line 32 is fixed to a lower face of the reseal portion 52 of the reseal label 5.

In the package 1B, since the two layers of the root portion 52 of the reseal label 5 and the separation piece 320 of the container 3 are adopted when the reseal label 5 is lifted, in other words, the two layers of the reseal label 5 and the separation piece 320 of the container 3 are continuous from the reseal portion 52 of the reseal label 5 to the fixed portion 51 via the root portion 52*a*, the reseal label 5 is further prevented from easily twisting when tightly sealing the reseal label 5, and the tightly-sealed state of the package 1 is improved.

The package 1B described above is never limited to the package illustrated in FIG. 11 to FIG. 15 but can be modified if necessary.

For example, in the package 1B described above, the reseal label 5 has the pair of notched portions 54, 54, but the reseal label 5 may have no notched portion 54. It should be noted, in the relationship between the pillow film and the reseal label 5, it is preferred, from a viewpoint of preventing the pillow film from being torn at the end portion 32*e* of the container 3 when the reseal label 5 is repeatedly opened and closed, that the reseal label 5 have the notched portions 54, 54.

Further, in the package 1B described above, as shown in FIG. 12, the positions of both the end portions 32*e*, 32*e* of the container cutting line 32 of the container 3 are disposed behind the positions of the pair of arc-shaped notched portions 54, 54 of the reseal label 5 in the first direction (Y direction), but may be disposed in front of the positions of the notched portions 54, 54 in the first direction (Y direction). Specifically, rearward vertexes in the first direction (Y direction) of the arc-shaped anti-tearing portions 33 of both the end portions 32*e*, 32*e* of the container cutting line 32 may be disposed in front of frontward vertexes in the first direction (Y direction) of the pair of arc-shaped notched portions 54, 54 of the reseal label 5 in the first direction (Y direction). Further, the positions of both the end portions 32*e*, 32*e* of the container cutting line 32 of the container 3 may be disposed in the same positions as the positions of the pair of arc-shaped notched portions 54, 54 of the reseal label 5.

Regarding the above-described embodiments of the present invention, the following additional statements (package) will be further disclosed below.

<1> A package provided with a container containing a packaged material, a covering sheet fixed so as to cover a dispensing slot which is to be formed in the container and which is for taking out the packaged material, and a reseal label stuck to an upper face of the covering sheet so as to cover a dispensing slot which is to be formed in the covering sheet and which is for taking out the packaged material, wherein the package has a first direction corresponding to an opening and closing direction of the reseal label, and a second direction orthogonal to the first direction, the reseal label has a fixed portion, which is fixed to the covering sheet, at one end portion side in the first direction, and a reseal portion capable of being peeled and lifted from the other end portion side of the reseal label in the first direction toward the fixed portion, the container has, on an upper face of the container, a container cutting line to form the dispensing slot of the container, on an upper face of the container, and the container cutting line is formed so as to project from the fixed portion side of the reseal label toward the other end portion side of the reseal label, the covering sheet has, outside the container cutting line, a covering-sheet cutting line to form the dispensing slot of the covering sheet and formed so as to project from the fixed portion side of the reseal label toward the other end portion side of the reseal label, and when the reseal portion of the reseal label is lifted in a case of taking out the packaged material, a root portion of the reseal label has a three-layered portion including the reseal label, a separation piece of the covering sheet fixed to the reseal label and separated along the covering-sheet cutting line, and a separation piece of the container fixed to the separation piece of the covering sheet and separated along the container cutting line.

<2> The package as set forth in clause <1>, wherein anti-tearing portions are formed at both end portions of the container cutting line, respectively.

<3> The package as set forth in clause <1> or <2>, wherein anti-tearing portions are formed at both end portions of the covering-sheet cutting line in the covering sheet, respectively.

<4> The package as set forth in clause <2> or <3>, wherein the anti-tearing portions of the container cutting line or the anti-tearing portions of the covering sheet are formed in an arc shape.

<5> The package as set forth in any one of clauses <1> to <4>, wherein the positions of both the end portions of the container cutting line are coincident with the positions of both the end portions of the covering-sheet cutting line.

<6> The package as set forth in any one of clauses <1> to <4>, wherein the positions of both the end portions of the container cutting line are disposed closer to the one end portion side of the reseal label than the positions of both the end portions of the covering-sheet cutting line are.

<7> The package as set forth in any one of clauses <1> to <4>, wherein the positions of both the end portions of the container cutting line are disposed closer to the other end portion side of the reseal label than the positions of both the end portions of the covering-sheet cutting line.

<8> The package as set forth in any one of clauses <1> to <7>, wherein a strip-like non-sticking portion including the covering-sheet cutting line is formed along the covering-sheet cutting line on a face facing the container of the covering sheet.

<9> The package as set forth in any one of clauses <1> to <8>, wherein the reseal label has a pair of notched portions at the one end portion side.

<10> The package as set forth in any one of clauses <1> to <9>, wherein the container cutting line has a pair of lateral side edges extending in the first direction, and the pair of lateral side edges extends in parallel to each other in the first direction, or extends so as to gradually increase a distance between the pair of lateral side edges from a front side toward a rear side in the first direction, or extends so as to gradually decrease a distance between the pair of lateral side edges from a front side toward a rear side in the first direction.

<11> The package as set forth in any one of clauses <1> to <9>, wherein the container cutting line has a pair of lateral side edges extending in the first direction, the pair of lateral side edges has a pair of first linear portions parallel to each other, and a pair of second linear portions extending toward the one end portion side of the reseal label continuously from the pair of first linear portions, and the pair of second linear portions is formed such that a distance in the second direction between the pair of second linear portions gradually decreases from the other end portion side of the reseal label toward the one end portion side.

<12> The package as set forth in any one of clauses <1> to <11>, wherein the covering-sheet cutting line has a pair of lateral side edges extending in the first direction, and the pair of lateral side edges extends in parallel to each other in the first direction, or extends so as to gradually increase a distance between the pair of lateral side edges from a front side toward a rear side in the first direction, or extends so as to gradually decrease a distance between the pair of lateral side edges from a front side toward a rear side in the first direction.

<13> The package as set forth in any one of clauses <1> to <11>, wherein the covering-sheet cutting line has a pair of lateral side edges extending in the first direction, the pair of lateral side edges has a pair of first linear portions parallel to each other, and a pair of second linear portions extending toward the one end portion side of the reseal label continuously from the pair of first linear portions, and the pair of second linear portions is formed such that a distance in the second direction between the pair of second linear portions gradually decreases from the other end portion side of the reseal label toward the one end portion.

<14> The package as set forth in any one of clauses <1> to <13>, wherein a front end edge of the container cutting line is formed in an arc shape projecting frontward in the first direction, or the front end edge linearly extends in a widthwise direction.

<15> The package as set forth in any one of clauses <2> to <14>, wherein the anti-tearing portions formed at both the end portions of the container cutting line are formed in a semicircular shape projecting rearward in the first direction so as to be directed outward in the second direction, or are formed in a semicircular shape projecting rearward in the first direction so as to be directed inward in the second direction, or formed in an arc shape projecting rearward in the first direction so as to be directed inward in the second direction, or formed in an arc shape projecting rearward in the first direction so as to be directed outward in the second direction.

<16> The package as set forth in any one of clauses <1> to <15>, wherein formation positions of both lateral side edges of the covering sheet are coincident with formation positions of both lateral side edges of the reseal label.

<17> The package as set forth in any one of clauses <1> to <16>, wherein a rear end edge of the covering sheet is coincident with a rear end edge of the reseal label.

<18> The package as set forth in any one of clauses <1> to <17>, wherein the shape of the covering-sheet cutting line and the shape of the container cutting line are substantially similar to each other.

<19> The package as set forth in any one of clauses <1> to <18>, wherein a sheet-like member forming the covering sheet is more rigid than a sheet-like member forming the reseal label, or the sheet-like member forming the covering sheet is more rigid than a sheet-like member forming the container.

<20> A package comprising a container containing a packaged material, and a reseal label stuck to an upper face of the container so as to cover a dispensing slot for taking out the packaged material, wherein the package has a first direction corresponding to an opening and closing direction of the reseal label, and a second direction orthogonal to the first direction, the reseal label has a fixed portion, which is fixed to a covering sheet, at one end portion side in the first direction, and a reseal portion capable of being peeled and lifted from the other end portion of the reseal label in the first direction toward the fixed portion, the container has, on an upper face of the container, a container cutting line to form the dispensing slot of the container, and the container cutting line is formed so as to project from the fixed portion side of the reseal label toward the other end portion side of the reseal label, when the reseal portion of the reseal label is lifted in a case of taking out the packaged material, a root portion of the reseal label has a two-layered portion composed of the reseal label and a separation piece of the container separated along the container cutting line, and anti-tearing portions are formed at both end portions of the container cutting line, respectively.

<21> The package as set forth in clause <20>, wherein the reseal label has a pair of notched portions at both side portions in the first direction.

<22> The package as set forth in clause <20> or <21>, wherein, in the package, in the first direction, the positions of both end portions of the container cutting line of the container are disposed behind the positions of the pair of notched portions of the reseal label in the first direction.

<23> The package as set forth in any one of clauses <20> to <22>, wherein the anti-tearing portions of the container cutting line are formed in an arc shape.

<24> The package as set forth in any one of clauses <20> to <23>, wherein the reseal label has a pair of notched portions at both side portions in the first direction.

<25> The package as set forth in any one of clauses <20> to <24>, wherein the container cutting line has a pair of lateral side edges extending in the first direction, and the pair of lateral side edges extends in parallel to each other in the first direction, or extends so as to gradually increase a distance between the pair of lateral side edges from a front side toward a rear side in the first direction, or extends so as to gradually decrease a distance between the pair of lateral side edges from a front side toward a rear side in the first direction.

<26> The package as set forth in any one of clauses <20> to <24>, wherein the container cutting line has a pair of lateral side edges extending in the first direction, the pair of lateral side edges has a pair of first linear portions parallel to each other, and a pair of second linear portions extending toward the one end portion side of the reseal label continuously from the pair of first linear portions, and the pair of second linear portions are formed such that a distance in the second direction between the pair of second linear portions gradually decreases from the other end portion side of the reseal label toward the one end portion side.

<27> The package as set forth in any one of clauses <20> to <26>, wherein a front end edge of the container cutting line is formed in an arc shape projecting frontward in the first direction, or the front end edge linearly extends in the second direction.

<28> The package as set forth in any one of clauses <20> to <27>, wherein the anti-tearing portions formed at both the end portions of the container cutting line are formed in a semicircular shape projecting rearward in the first direction so as to be directed outward in the second direction, or are formed in a semicircular shape projecting rearward in the first direction so as to be directed inward in the second direction, or are formed in an arc shape projecting rearward in the first direction so as to be directed inward in the second direction, or are formed in an arc shape projecting rearward in the first direction so as to be directed outward in the second direction.

INDUSTRIAL APPLICABILITY

According to the package of the present invention, a ridge or a crease around the dispensing slot is not easily caused by repeating opening and closing operations for performing opening and closing using the reseal label, and further the reseal label is prevented from easily twisting when the package is tightly sealed with the reseal label, so that the tightly-sealed state of the package can be maintained.

The invention claimed is:

1. A package provided with a container containing a packaged material, a covering sheet fixed so as to cover a dispensing slot which is to be formed in the container and which is for taking out the packaged material, and a reseal label stuck to an upper face of the covering sheet so as to cover a dispensing slot which is to be formed in the covering sheet and which is for taking out the packaged material, wherein the package has a first direction corresponding to an opening and closing direction of the reseal label, and a second direction orthogonal to the first direction, the reseal label has a fixed portion, which is fixed to the covering sheet, at one end portion side in the first direction, and a reseal portion capable of being peeled and lifted from the other end portion side of the reseal label in the first direction toward the fixed portion, the container has, on an upper face of the container, a container cutting line to form the dispensing slot of the container, and the container cutting line is formed so as to project from the fixed portion side of the reseal label toward the other end portion side of the reseal label, the covering sheet has, outside the container cutting line, a covering-sheet cutting line to form the dispensing slot of the covering sheet and formed so as to project from the fixed portion side of the reseal label toward the other end portion side of the reseal label, a strip-like non-sticking portion including the covering-sheet cutting line is formed along the covering-sheet cutting line on a face facing the container of the covering sheet, and when the reseal portion of the reseal label is lifted in a case of taking out the packaged material, a root portion of the reseal label has a three-layered portion including the reseal label, a separation piece of the covering sheet fixed to the reseal label and separated along the covering-sheet cutting line, and a separation piece of the container fixed to the separation piece of the covering sheet and separated along the container cutting line.

2. The package according to claim 1, wherein anti-tearing portions are formed at both end portions of the container cutting line, respectively.

3. The package according to claim 1, wherein anti-tearing portions are formed at both end portions of the covering-sheet cutting line in the covering sheet, respectively.

4. The package according to claim 2, wherein the anti-tearing portions of the container cutting line or the anti-tearing portions of the covering sheet are formed in an arc shape.

5. The package according to claim 1, wherein the positions of both the end portions of the container cutting line are coincident with the positions of both the end portions of the covering-sheet cutting line.

6. The package according to claim 1, wherein the positions of both the end portions of the container cutting line are disposed closer to the one end portion side of the reseal label than the positions of both the end portions of the covering-sheet cutting line.

7. The package according to claim 1, wherein the positions of both the end portions of the container cutting line are disposed closer to the other end portion side of the reseal label than the positions of both the end portions of the covering-sheet cutting line.

8. The package according to claim 1, wherein the reseal label has a pair of notched portions at the one end portion side.

9. The package according to claim 1, wherein the container cutting line has a pair of lateral side edges extending in the first direction, and the pair of lateral side edges extends in parallel to each other in the first direction, extends so as to gradually increase a distance between the pair of lateral side edges from a front side toward a rear side in the first direction, or extends so as to gradually decrease a distance between the pair of lateral side edges from a front side toward a rear side in the first direction.

10. The package according to claim 1, wherein the container cutting line has a pair of lateral side edges extending in the first direction, the pair of lateral side edges of the container cutting line has a pair of first linear portions parallel to each other, and a pair of second linear portions extending toward the one end portion side of the reseal label continuously from the pair of first linear portions, and the pair of second linear portions is formed such that a distance in the second direction between the pair of second linear portions gradually decreases from the other end portion side of the reseal label toward the one end portion side.

11. The package according to claim 1, wherein the covering-sheet cutting line has a pair of lateral side edges extending in the first direction, and the pair of lateral side edges of the covering-sheet cutting line extends in parallel to each other in the first direction, extends so as to gradually increase a distance between the pair of lateral side edges from a front side toward a rear side in the first direction, or extends so as to gradually decrease a distance between the pair of lateral side edges from a front side toward a rear side in the first direction.

12. The package according to claim 1, wherein the covering-sheet cutting line has a pair of lateral side edges extending in the first direction, the pair of lateral side edges of the covering-sheet cutting line has a pair of first linear portions parallel to each other, and a pair of second linear portions extending toward the one end portion side of the reseal label continuously from the pair of first linear portions, and the pair of second linear portions is formed such that a distance in the second direction between the pair of second linear portions gradually decreases from the other end portion side of the reseal label toward the one end portion.

13. The package according to claim 1, wherein a front end edge of the container cutting line is formed in an arc shape projecting frontward in the first direction, or the front end edge linearly extends in a widthwise direction.

* * * * *